US009357282B2

(12) United States Patent
Gan et al.

(10) Patent No.: US 9,357,282 B2
(45) Date of Patent: May 31, 2016

(54) LISTENING DEVICE AND ACCOMPANYING SIGNAL PROCESSING METHOD

(75) Inventors: Woon Seng Gan, Singapore (SG); Ee Leng Tan, Singapore (SG)

(73) Assignee: Nanyang Technological University, Singapore (SG)

( * ) Notice: Subject to any disclaimer, the term of this patent is extended or adjusted under 35 U.S.C. 154(b) by 0 days.

(21) Appl. No.: 14/009,079

(22) PCT Filed: Apr. 2, 2012

(86) PCT No.: PCT/SG2012/000116

§ 371 (c)(1), (2), (4) Date: Sep. 30, 2013

(87) PCT Pub. No.: WO2012/134399

PCT Pub. Date: Oct. 4, 2012

(65) Prior Publication Data

US 2014/0153765 A1 Jun. 5, 2014

Related U.S. Application Data

(60) Provisional application No. 61/470,135, filed on Mar. 31, 2011.

(51) Int. Cl.

| | |
|---|---|
| ***H04R 25/00*** | (2006.01) |
| ***H04R 1/10*** | (2006.01) |
| ***H04S 3/00*** | (2006.01) |
| *H04R 5/033* | (2006.01) |

(52) U.S. Cl.

CPC ..... *H04R 1/10* (2013.01); *H04R 1/1075* (2013.01); *H04S 3/004* (2013.01); *H04R 5/033* (2013.01); *H04S 2400/01* (2013.01); *H04S 2420/01* (2013.01)

(58) Field of Classification Search

CPC ..... H04R 5/033; H04R 1/1016; H04R 1/1066

USPC ..... 381/374, 370, 371, 372, 309, 74, 72, 381/71.6

See application file for complete search history.

(56) References Cited

U.S. PATENT DOCUMENTS

| | | | | |
|---|---|---|---|---|
| 3,796,840 | A | 3/1974 | Ohta | |
| 3,984,885 | A | 10/1976 | Yoshimura et al. | |
| 6,356,644 | B1 * | 3/2002 | Pollak | H04R 1/1008 181/129 |
| 6,434,250 | B1 * | 8/2002 | Tsuhako | 381/374 |
| 6,603,863 | B1 | 8/2003 | Nagayoshi | |
| 7,068,803 | B2 | 6/2006 | Kuhlmann et al. | |
| 7,155,025 | B1 * | 12/2006 | Weffer | H04R 5/033 381/370 |

(Continued)

OTHER PUBLICATIONS

Konig, "A New Supra-Aural Dynamic Headphone System for In-Front Localization and Surround Reprodcution of Sound", presented at the 102nd AES Convention, Munich, Germany, Mar. 1997.

(Continued)

*Primary Examiner* — Brian Ensey
*Assistant Examiner* — Julie X Dang
(74) *Attorney, Agent, or Firm* — Lee & Hayes, PLLC

(57) ABSTRACT

A listening device (120; 220; 320), such as a pair of headphones, is provided for wearing by a user. It contains two or more sound emitters for directing sound to each ear (2) of the user. At least one of the sound emitters (116; 216, 316) is positioned such that sound is emitted in a direction substantially perpendicular to the axis of the ear canal (10) of the ear, and towards the wall of the concha (6) of the ear (2).

17 Claims, 11 Drawing Sheets

(56) References Cited

U.S. PATENT DOCUMENTS

| | | | | |
|---|---|---|---|---|
| 8,000,490 | B2 * | 8/2011 | Yang | H04R 1/1075 381/309 |
| 2002/0122562 | A1 * | 9/2002 | Brennan | H03H 17/0266 381/316 |
| 2004/0196991 | A1 * | 10/2004 | Iida et al. | 381/309 |
| 2004/0264727 | A1 * | 12/2004 | Kim | H04R 1/2819 381/370 |
| 2008/0147763 | A1 * | 6/2008 | Levin | 708/400 |
| 2009/0093896 | A1 * | 4/2009 | Kobayashi | G01H 3/08 700/94 |
| 2009/0161895 | A1 * | 6/2009 | Hruza | 381/309 |
| 2009/0175473 | A1 * | 7/2009 | Wong | H04R 1/1075 381/309 |
| 2009/0252361 | A1 | 10/2009 | van Halteren | |
| 2011/0038484 | A1 * | 2/2011 | Macours | H04R 5/04 381/17 |

OTHER PUBLICATIONS

Moller et al., "Transfer Characteristics of Headphones Measured on Human Ears," J. Audio Eng. Soc., vol. 43, Apr. 1995, pp. 203-217.

Tan et al., "Direct Concha Excitation for the Introduction of Individualized Hearing Cues", J. Audio Eng. Soc., vol. 48, Jul./Aug. 2000, pp. 642-653.

* cited by examiner

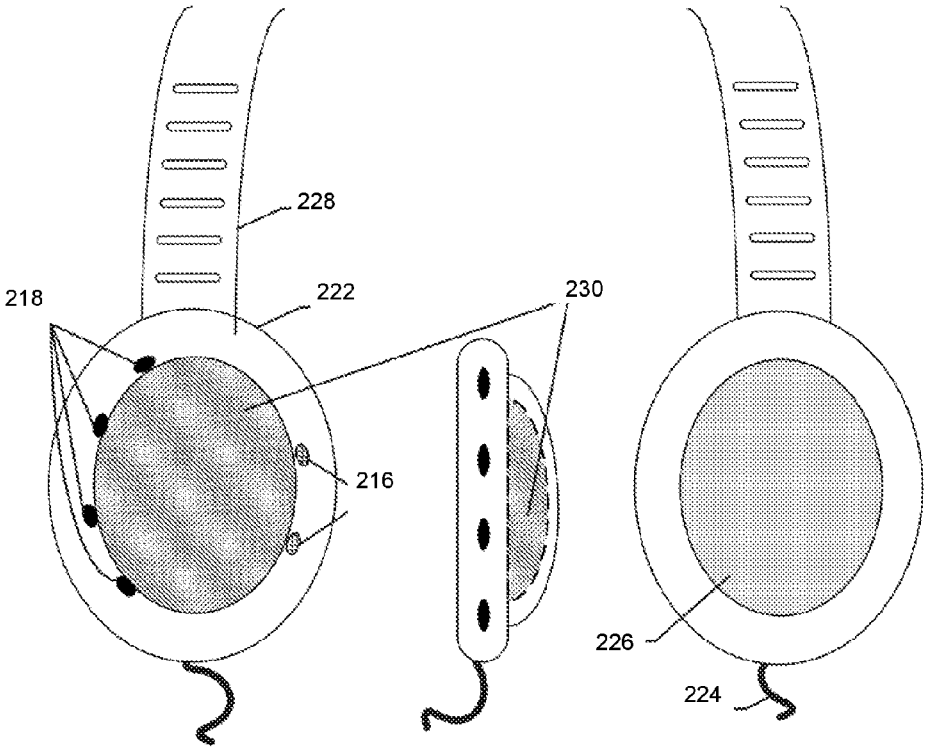
Figure 4a Figure 4b Figure 4c
Figure 4d
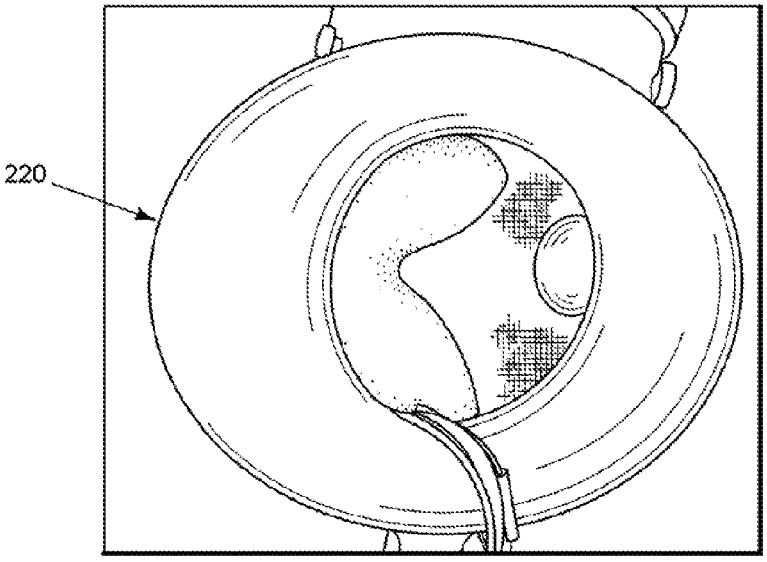

LISTENING DEVICE AND ACCOMPANYING SIGNAL PROCESSING METHOD

This Application claims priority to International Patent Application No. PCT/SG2012/000116, filed Apr. 2, 2012, entitled "Listening Device and Accompanying Signal Processing Method", which claims priority to U.S. Provisional Patent Application No. 61/470,135, filed Mar. 31, 2011, which is incorporated herein by reference.

TECHNICAL FIELD

The invention relates to a listening device such as but not limited to headphones, and an accompanying signal processing method for use in, but not limited to, binaural 3-D audio reproduction.

BACKGROUND ART

Conventionally, the binaural (or hearing with two ears) 3D audio reproduction system uses a pair of headphones to reproduce the binaurally recorded or synthesized sound so that a listener can perceive sound images coming from certain locations, such as front, rear, up, above, near, and far in 3D space surrounding the listener. However, there are limitations in the conventional headphone system, which prevents the listener from accurately perceiving 3D audio.

Firstly, Møller [1] reasoned that the headphone coupling characteristics were not the same as the characteristics of free field sound sources.

Secondly, there are shape and size variations in human heads and ears—no two people have the same ear shape. Therefore, a binaural sound captured with a dummy head or synthesized using a generic set of Head-Related Transfer Functions (HRTFs), a set of sound source measurements in a 3D space surrounding the listener, will be perceived differently by different people. To overcome this issue, either individualized recording or individualized HRTFs for binaural synthesis are required, which are both tedious to perform.

Thirdly, it is well known that headphone listening causes sound to be perceived as coming from inside the head (far and near sound are perceived to be the same)—there is a tendency for sound image to be perceived from the rear for frontal sound cues, thus causing front/back confusion.

There are a number of improved 3D-audio enhanced headphones [2-6] that are designed with multiple sound emitters and off-positioned sound emitters in existing surround headphones. However, although such headphones have different sound emitters positioned at different locations in the ear, all sound emitters are positioned directing sound in parallel directions towards the opening of the ear entrance, as illustrated in FIG. 2. This limits the enhancement of the positional perception.

SUMMARY OF INVENTION

In general terms the invention proposes that a given ear is provided with two sets of sound emitters: at least one first sound emitter which directs sound against a wall portion of the concha (the part of the concha which extends outwardly from the head), and a second sound emitter which directs sound at the pinna from a different direction.

Specifically, in an aspect of the invention, there is provided a listening device for wearing by a user, comprising:

at least one support structure for positioning on or adjacent both ears of the user;

said at least one support structure including, for each ear, one or more corresponding first sound emitters and one or more corresponding second sound emitters;

characterised in that when the listening device is worn by the user, the first and second sound emitters are positioned such that, for each ear:

the one of more first corresponding first sound emitters direct sound in a different direction from the one or more corresponding second sound emitters; and the one or more corresponding first sound emitters direct sound at a wall portion of the concha of the ear.

Typically the one or more first sound emitters emit sound in a direction substantially perpendicular to the axis of the ear canal. Typically at least one first sound emitter is positioned to the anterior of the ear when worn by the user.

Advantageously the individualized surface in the concha creates an individualized sound reflection that has been found to enhance binaural listening. This new positioning of sound emitters also results in externalization of sound source, with better frontal sound image.

In one embodiment at least one second sound emitter is positioned behind the pinna of said one or both ears when the listening device is worn by the user. Typically the second sound emitter(s) behind the ear are vibration exciters for generating low frequencies. Typically at least one second sound emitter is positioned to the posterior of the ear when worn by the user.

Advantageously if the first sound emitter(s) has a reduced low-frequency transmission compared to the conventional headphones, sound emitters (rear vibrating emitters) can be placed behind the pinna to create dynamic bass as well as a sense of sound proximity, thereby overcoming the deficiency. The bandwidth of the first sound emitters may be broadband and generate frequencies up to 20 KHz, and the bandwidth of the rear vibrating emitters (i.e. sound emitters that are placed behind the pinna) is frequencies up to about 500 Hz In a further embodiment at least one second sound emitter is positioned such that sound is directed towards to ear canal of the corresponding ear when the listening device is worn by the user. Typically at least one second sound emitter emits sound in a direction substantially parallel to the axis of the ear canal. Advantageously if the first and second sound emitters are large enough to produce low frequencies, sound emitters behind the pinna are not required, resulting in a simplified design of the listening device. The bandwidth of the first and second sound emitters may again be broadband and generate frequencies up to 20 KHz.

In one embodiment the support structure includes two earcups (one for each of the user's ears), each earcup enclosing the corresponding sound emitters.

In one embodiment the listening device includes left and right sides corresponding to the user's ears, and the support structure includes an over-the-head headband or behind the head loop connecting said left and right sides.

In one embodiment the support structure includes a spectacles/glasses structure in which the sound emitters are embedded.

In a further aspect of the invention, there is provided a method of processing signals for a listening device worn by a user, comprising the steps of:

extracting cues from sound sources;

processing the cues to generate a plurality of sound signals;

delivering one or more of the sound signals to one or more first sound emitters, and a different one or more of the sound signals to one or more second sound emitters;

characterised in that the one or more first sound emitters emit sound in a direction making an angle of at least about 60 degrees to the axis of an ear canal of a user. Preferably the angle is at least 70 degrees, and it may be up to 90 degrees (i.e. substantially perpendicular to the axis of the ear canal).

The first ear speakers may actually generate sound propagating in a range of directions (i.e. spanning a range of angles), and if so, the angles of 60, 70 and 90 degrees mentioned above refer to the angle between the axis of the ear canal and the central direction in the range of directions.

In one embodiment at least some of the sound signals are delivered to a second sound emitter positioned behind the pinna of said one or both ears.

In a further embodiment at least some of the sound signals are delivered to a second sound emitter which emits sound in a direction parallel the ear canal of the user.

In one embodiment the cues are processed via convolution with a set of head related impulse responses.

In one embodiment the cues are processed with a filterbank structure and/or adjustable gain.

In one embodiment the cues are processed to separate the frontal and side signals from the audio input, by computing the correlation and time differences between the left and right signals. Typically highly correlated signals with small time differences are delivered to the first sound emitters.

BRIEF DESCRIPTION OF DRAWINGS

It will be convenient to further describe the present invention with respect to the accompanying drawings that illustrate possible arrangements of the invention. Other arrangements of the invention are possible, and consequently the particularity of the accompanying drawings is not to be understood as superseding the generality of the preceding description of the invention.

FIG. 4 schematically illustrates a portion of a listening device according to a further embodiment of the invention (a) rear view; (b) side view; (c) front view; and (d) prototype rear view.

DETAILED DESCRIPTION

Figures 1A, 1B, 1C, 1D:
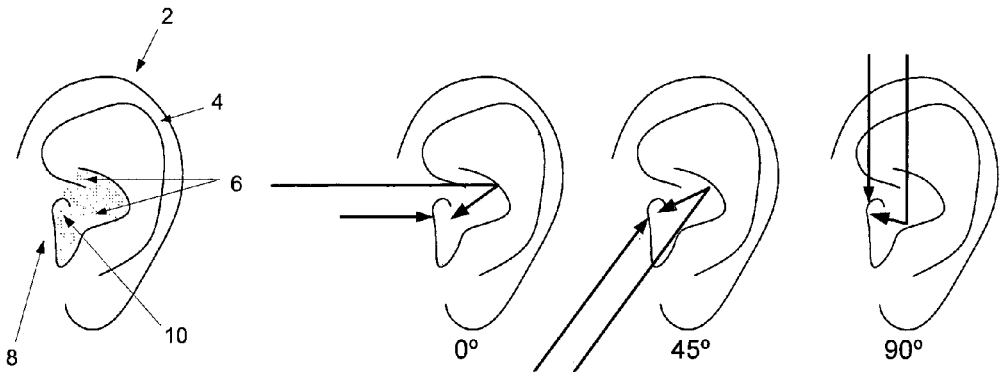
FIG. 1 is a schematic view of a human outer ear illustrating (a) nomenclature thereof; and with a sound signal arriving at an angle of (b) 0°; (c) 45°; and (d) 90°.

FIG. 1*a* shows different parts of the human outer ear 2, namely the pinna 4, concha 6, tragus 8 and ear canal 10. FIGS. 1*b-d* illustrate how a signal arriving at different angles is reflected. No two people have the same ear shape, and therefore a binaural sound captured with a dummy head or synthesized using a generic set of Head-Related Transfer Functions (HRTFs) will be perceived differently by different people. The concha 6 has a floor portion approximately parallel to the side of human's head, and a wall portion upstanding from a rear edge of the floor portion (that is, the wall portion extends outwardly from the human's head), and terminating in areas called the anti-helix and the anti-tragus.

Figure 2:
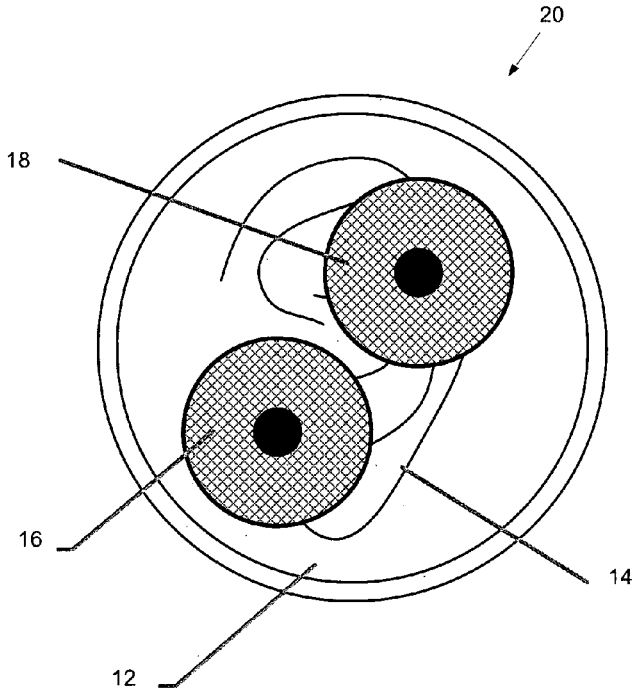
FIG. 2 schematically illustrates a known headphone design relative to a user's ear.

FIG. 2 illustrates a known headphone design 20 including an ear cup 12 for mounting in relation to the left pima 14. The ear cup 12 supports a front speaker 16 and a surround speaker 18.

Figure 3A:
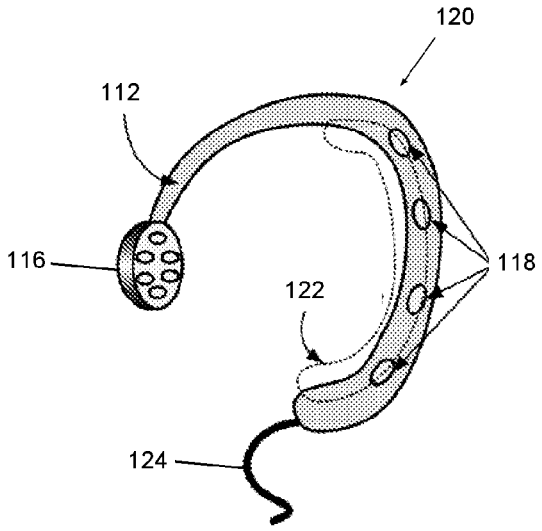
FIG. 3 illustrates a listening device according to an embodiment of the invention (a) schematic view; (b) positioned on a user's ear; (c) prototype side view placed on a head.
Figure 3B:
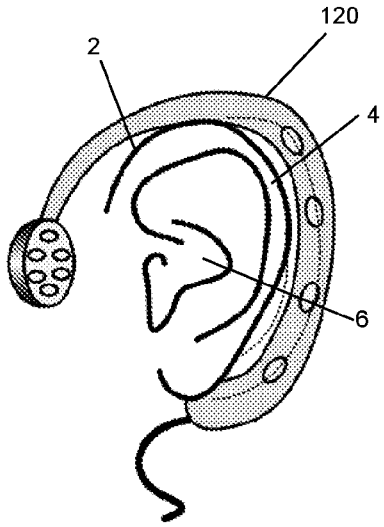
Figure 3C:
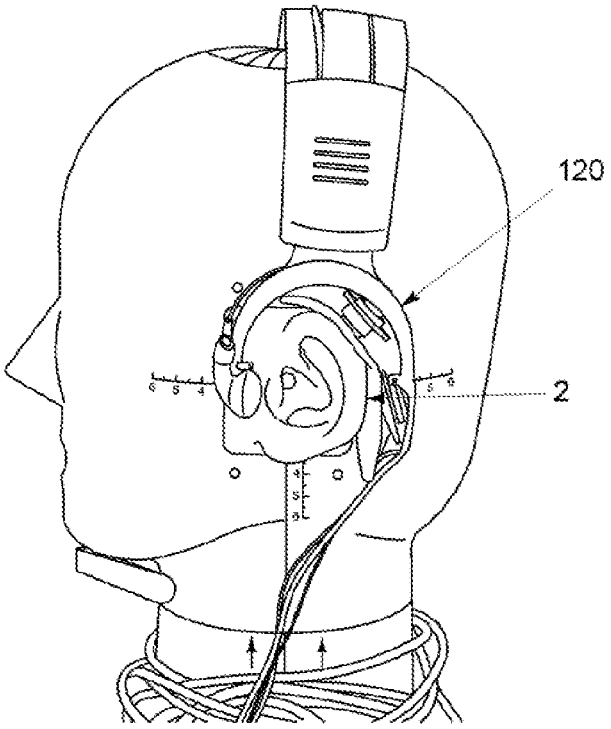

FIGS. 3*a-c* show a listening device 120 according to an embodiment of the invention, comprising a support structure in the form of a loop 112 for fitting on a user's ear 2, a primary sound emitter in the form of a headphone driver 116 which is positioned in front of the ear such that sound is aimed directly towards the wall portion of the concha, and a number of secondary sound emitters in the form of vibration exciters 118 which are positioned around the ear to generate complementary vibration signals to the outer ear.

By making use of different reflections around the listener's concha area, the 3D sound perception is enhanced. The primary headphone driver 116 (first sound emitter) is positioned near the tragus 8 and points towards the wall portion of the concha 6 (sound signal arrives at an angle of 0°), instead of the normal headphones' position that directs sound perpendicular to the overall plane of the pinna 4. The sound generated by the headphone driver 116 propagates in a direction which is substantially horizontal, and substantially perpendicular to the axis of the ear canal. The headphone driver 116 projects sound waves towards the wall portion of the concha 6, and causes concha reflection. This approach enhances 3D sound perception through individualized cues produced from an individual's concha shape, size, and depth. Through measurement and subjective listening tests, improved sound externalization and front sound image can be achieved. However, the new position of the headphone driver 116 can greatly reduce the bass frequency response, and therefore vibration exciters 118 are used to compensate for the loss of low frequency.

The vibration exciters 118 (second sound emitters) are interfaced with foam or membrane 122 to transmit the vibration to the pinna (or outer ear) 4. A cable 124 is provided to transmit the signals to the sound emitters.

Advantageously, by combining concha-wall-directed exciters and vibration exciters in a single headphones unit in different configurations, more immersive and realistic 3D-audio playback can be created for use in connection with today's 3D media applications, such as 3D TV.

In more detail, the advantages include:

1. Individualized HRTF cues are produced using the unique shape of the human ear. These individualized HRTF cues result in better accuracy in perceiving sound source location, especially for frontal sound sources in a 3D audio headphone reproduction.

2. Reduction of the rear sound source biasness or front-back sound source confusion through the use of concha-excited driver. This driver configuration also improves on the externalization of the sound source, and reduces the in-the-head experience (near and far sounds are perceived to be the same).

3. The vibrating exciters placed at strategic positions around the ear add deeper and thumping bass effect, and enhance the low-frequency perception.

4. The vibrating exciters also add a sense of proximity (sound source close to the ear) to give the effect of someone speaking/whispering close to your ear. This feature can greatly enhance gaming effects.

With reference to FIGS. 4*a-d* there is illustrated a further embodiment of the invention wherein both the concha exciters 216 and vibration exciters 218 are located in an enclosure or earcup 226 to contain the sound so that it will not disturb others and reduces ambient noise level coming to the ear. Foam and/or padding 222 provides comfort in these circumaural device. In this embodiment side firing emitters 230, as found in conventional headphones, are also located in the earcup 226.

The device 220 can be worn on the head with the help of an over-the-head headband 228 or behind the head loop connecting the right and left side of the headphone, or embedded in a spectacles/glasses structure. Signals can be carried via a cable 224 or the device can be wireless. These different structures can potentially create many different types of headphones' design that can be applied to gaming, 3D-TV, and other interactive media applications.

Figure 5:
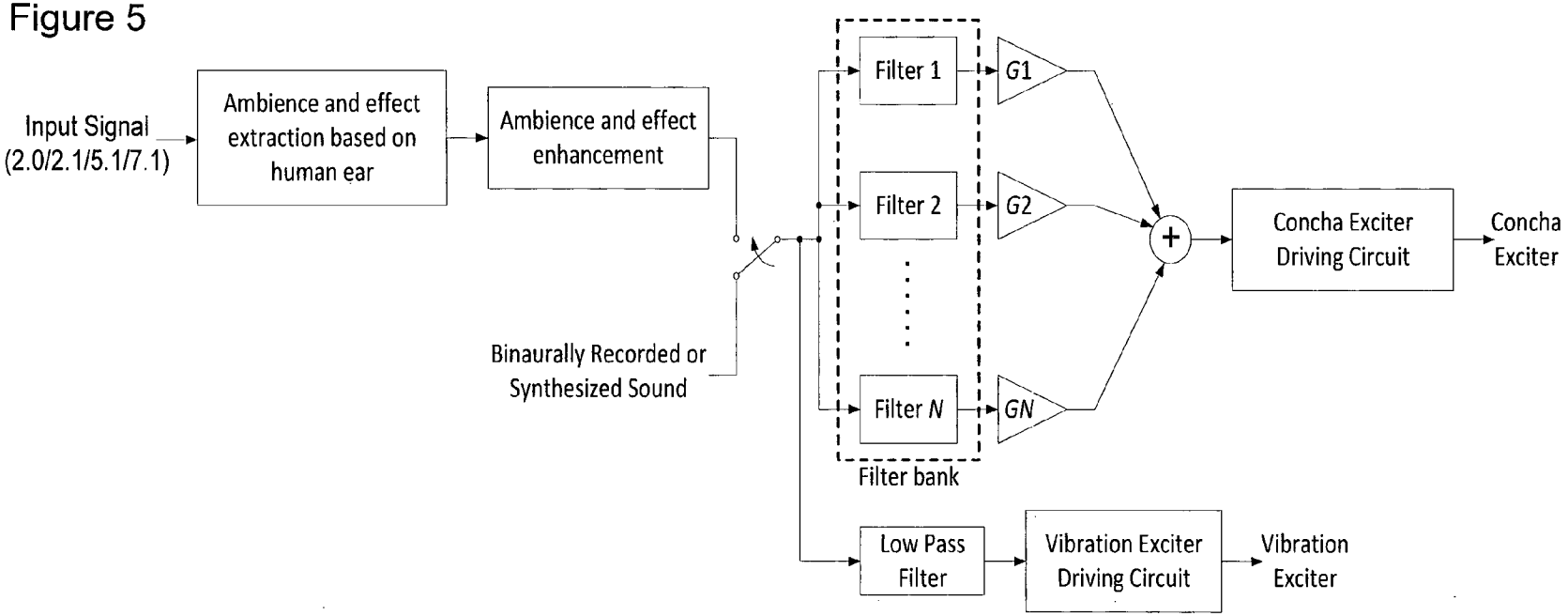
FIG. 5 schematically illustrates an audio signal processing and sound distribution algorithm in accordance with the embodiments of the invention shown in FIGS. 3*a*-4*d*.

In order to achieve a good 3D sound source positional effect on the new headphone structure, proprietary audio signal processing and sound distribution algorithms are implemented, as illustrated in FIG. 5. The main role of the signal processing algorithm is to extract critical cues in the sound sources, such as stereo, binaural, multi-channel surround sound; and to perform the required audio signal processing (i.e. HRTF filtering, scaling, and mixing) and delivery to the different exciters.

The algorithm, called the ambience and effect extraction based on human ear (ACEHE), performs the required effect and ambience extraction from stereo or surround sound audio signals. These extracted effect and ambience contents are then channelled into the concha and vibration exciters in the listening device for the optimal audio experience.

The extracted ambience and effect contents are further enhanced by signal processing algorithms, such as convolution with a set of head related impulse response (HRIR) to improve the 3D sound perception and deconvolution to improve sound externalization.

Furthermore, a combined front-back biasness circuit and headphone equalizer based on a filterbank structure and adjustable gains G1, G2, . . . GN (each gain varies from 0 to 1) are also implemented in the signal processing unit. In addition, a low pass filter is included to produce the signal for the vibration exciter. A specially designed concha exciter driving circuit is used to drive the concha exciters of the 3D headphone.

Figure 6A:
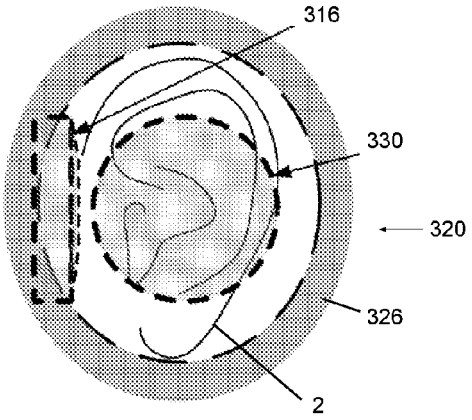
FIG. 6 illustrates a listening device according to a yet further embodiment of the invention (a) schematic side view; (b) schematic front view; (c) prototype side view; (d) prototype side view without foam.
Figure 6B:
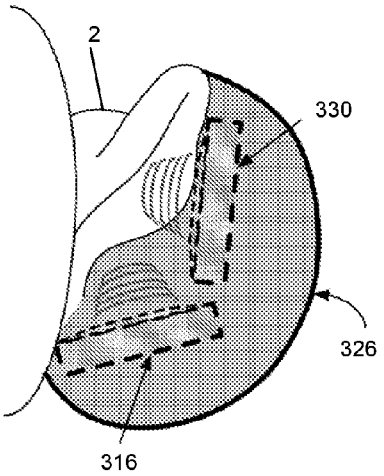
Figure 6C:
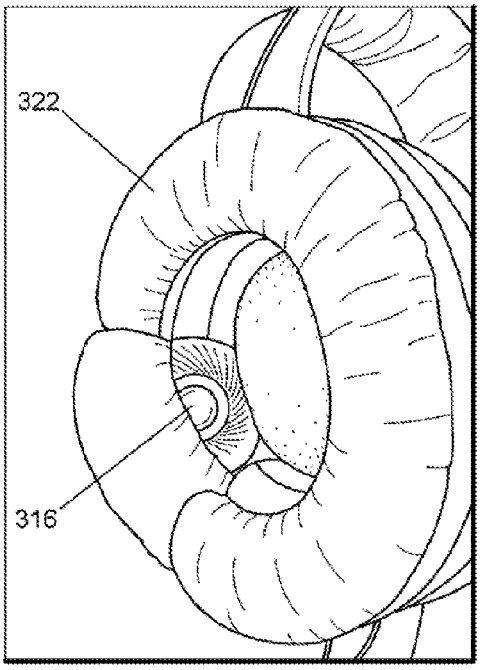
Figure 6D:
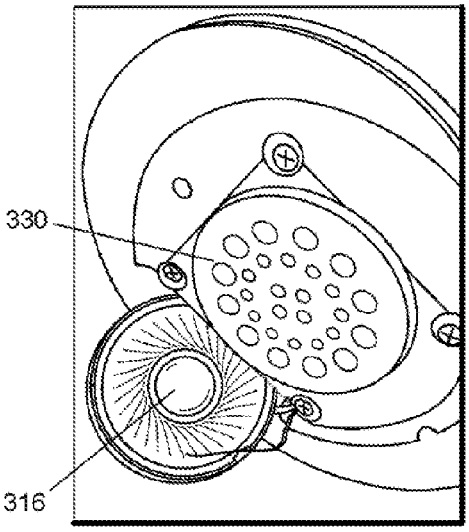

With reference to FIGS. 6*a-d*, a yet further embodiment of the invention is illustrated, wherein the listening device 320 has front emitters 316 for firing directly at the concha wall, but instead of rear emitters for positioning behind the pinna the earcups 326 include side emitters 330 directing sound towards and substantially parallel to the ear canal. As described above sound is projected into the concha to generate individualized 3D cues based on the unique shape of the human ear 2. FIGS. 6*c-d* illustrate a prototype of the device with and without foam 322. The front emitters project sound in a direction which is at about 70 degrees to the axis of the ear canal. This sound propagation direction in this embodiment also is in the horizontal plane.

Thus instead of placing several concha exciters and vibration exciters in respective front and rear sections of the earcup of a circumaural headphone, a single frontal emitter 316 can be used together with the side firing emitter 330 found in conventional headphones. Using a sufficient large frontal exciter to replace the smaller concha exciters, the problem of positioning of the concha exciters is avoided. Also a sufficient large frontal emitter, as well as the side firing emitter, are capable of producing low frequencies. Therefore, the vibration exciters can be avoided in this embodiment to reduce cost and power consumption. However, the vibration exciters can optionally be included to provide proximity sensation in gaming.

Figure 7:
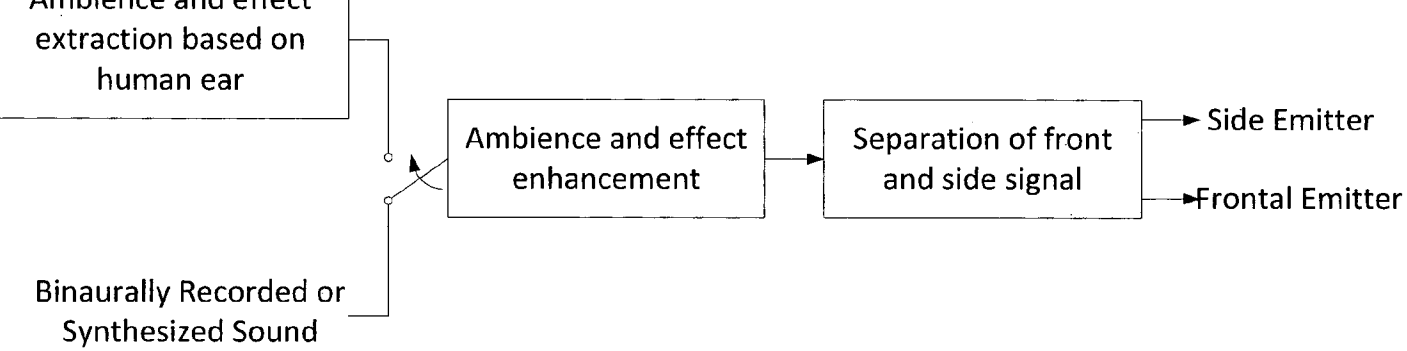
FIG. 7 schematically illustrates an audio signal processing and sound distribution algorithm in accordance with the embodiment of the invention shown in FIGS. 6*a-d*.

The algorithm of this embodiment may implement in several ways. One possible approach, also simplified, is as illustrated in FIG. 7. A new module is introduced to separate the frontal and side signals from the audio input. This is achieved by computing the correlation and time differences between the left and right signals. A highly correlated signal with small time differences indicates frontal signal and this audio content should be channelled to the front exciters, whereas the remaining audio content is channelled to the side exciters. Since the front and side signals are separated by this new module, it is not necessary to retain the filter bank structure, although this can still be included to further enhance the front-back differences and improve the sound perception through equalization effect. As the exciters used in the headphone structure shown in FIGS. 6*a-d* produce sufficient low frequencies, there is no need for vibration exciters and the corresponding required processing by a low pass filter and vibration exciter circuit.

Figure 8:
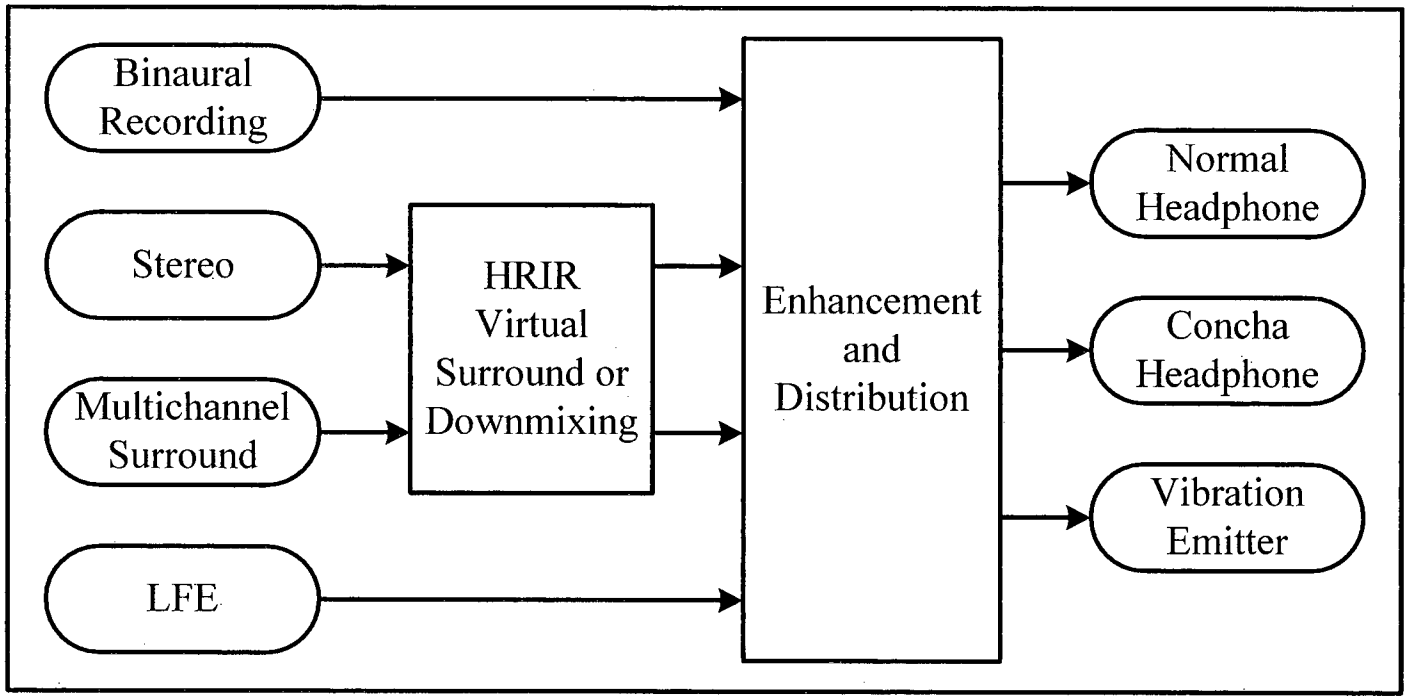
FIG. 8 schematically illustrates the main processing blocks for a signal processing technique in accordance with an embodiment of the invention.

The main processing blocks of the signal processing technique is illustrated in FIG. 8. The signal processing technique includes binaural synthesis by convolution with head-related impulse response (HRIR) and Blauert's front-back biasing (multiband equalizers) circuit, as well as crossover mixing and audio enhancement filtering to produce signals for the vibrating exciters.

The processing blocks accept audio signals in different audio formats, namely binaural recording, 2 channel stereo sound, multichannel surround (5.1 format), and also the low frequency enhancement (LFE) signal. This flexibility allows signals from different sources (gaming, movie, and other digital media) to be processed and distributed to different emitters.

A two-stage approach is used. First, the multi-format signals are converted to a 2-channel format either using binaural synthesis (with HRTF or virtual surround) or through surround to stereo downmixing. Binaural recording and LFE need not go through this processing. The second stage involves special signal processing techniques before distributing to the various headphone drivers and vibrating emitters.

First Stage: Conversion to 2-Channel Format

The first stage applies necessary conversion from stereo and multichannel surround signals to a 2-channel format signal. Two possible conversion techniques include:

1. Binaural Synthesis or Virtual Surround

This conversion process applies HRTF filtering on the number of input channel, which correspond to the location of the virtual loudspeakers, to simulate a binaural signal. It accepts stereo and 5-channel surround signals. For stereo signals, only the L and R signals are inputted to the processing block.

Figure 9:
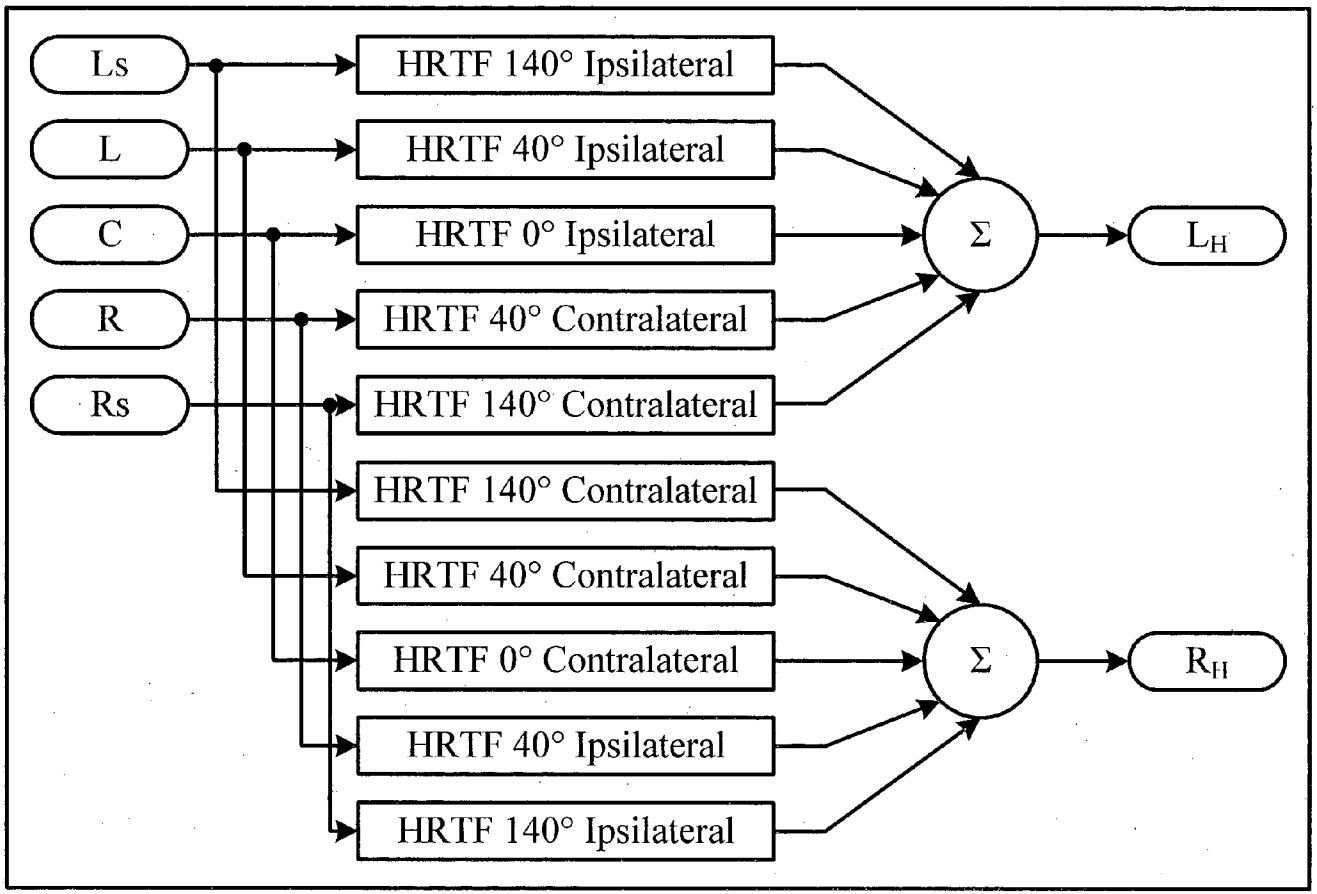
FIG. 9 schematically illustrates the convolution of the 5 channels of surround sound signal and mixes into a 2-channel virtual surround signal.

The HRIR filter coefficients are obtained from an open source of HRTF database (128 taps). The virtual positions of loudspeakers are set at 0° for the center channel (C), ±40° for the left (L) and right (R) channel, and ±140° for the surround channels. In the ITU-R BS 775.2 standard, the recommended loudspeaker placement angle for the 5.1 surround setup is at 0° for the center channel (C), ±30° for the left (L) and right (R) channel, and ±110° for the surround channels. In this processing, ±40° is chosen instead of ±30° to increase the perceived width of the sound stage; ±140° is chosen instead of ±110° to improve the rear imaging. A complete diagram for creating a virtual surround is shown in FIG. 9. Note that this is just one of many possibilities within the scope of the invention.

2. Left-Only Right-Only ($L_O$-$R_O$) Downmixing

Figure 10:
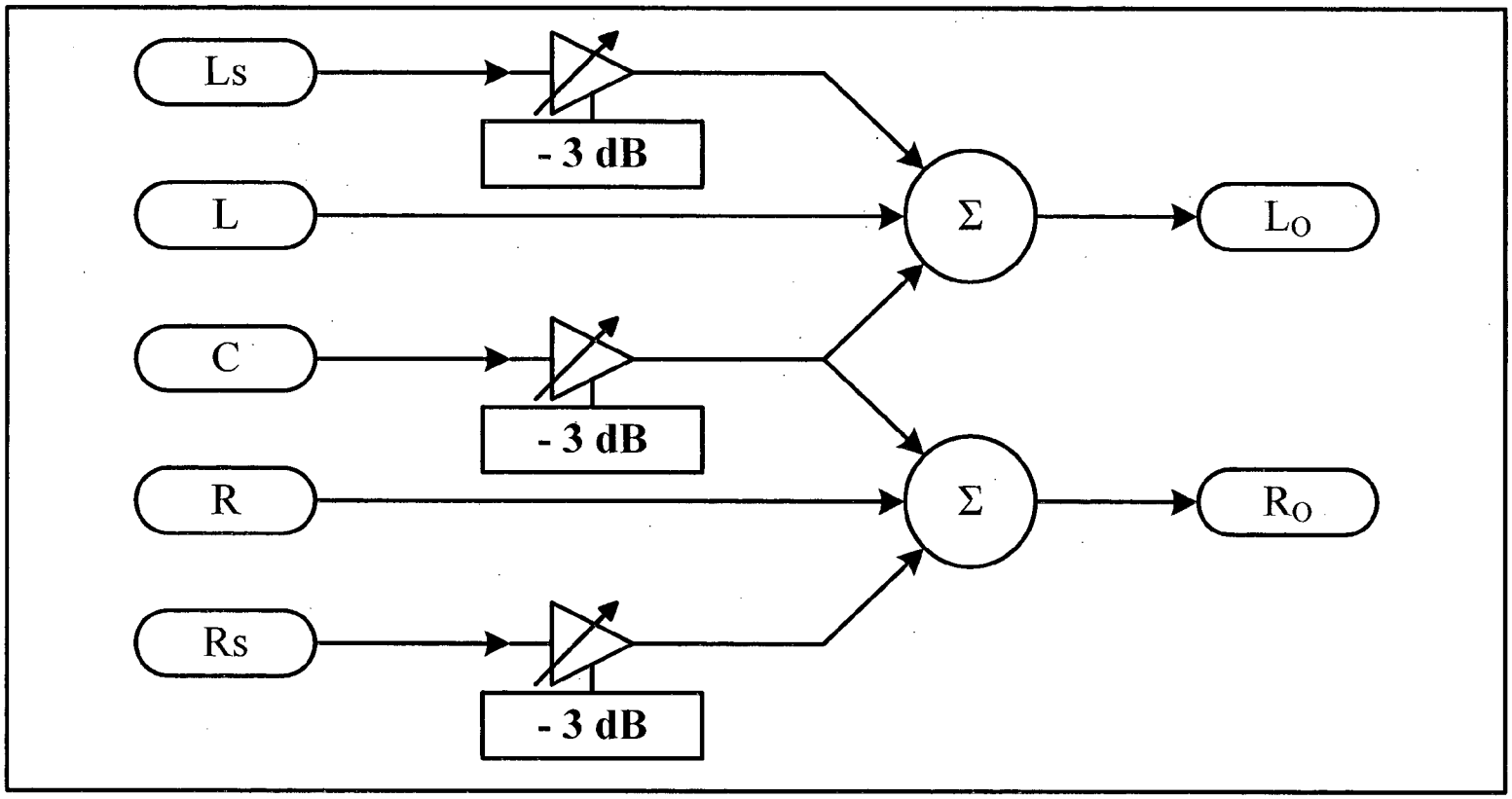
FIG. 10 schematically illustrates $L_O$-$R_O$ downmixing.

This conversion process is a computationally simpler alternative to the binaural synthesis shown in FIG. 9. The block diagram of one possible way of performing the $L_O$-$R_O$ downmixing is shown in FIG. 10. Again, many other possibilities exist within the scope of the invention.

Second Stage: Enhancement and Distribution

Figure 11:
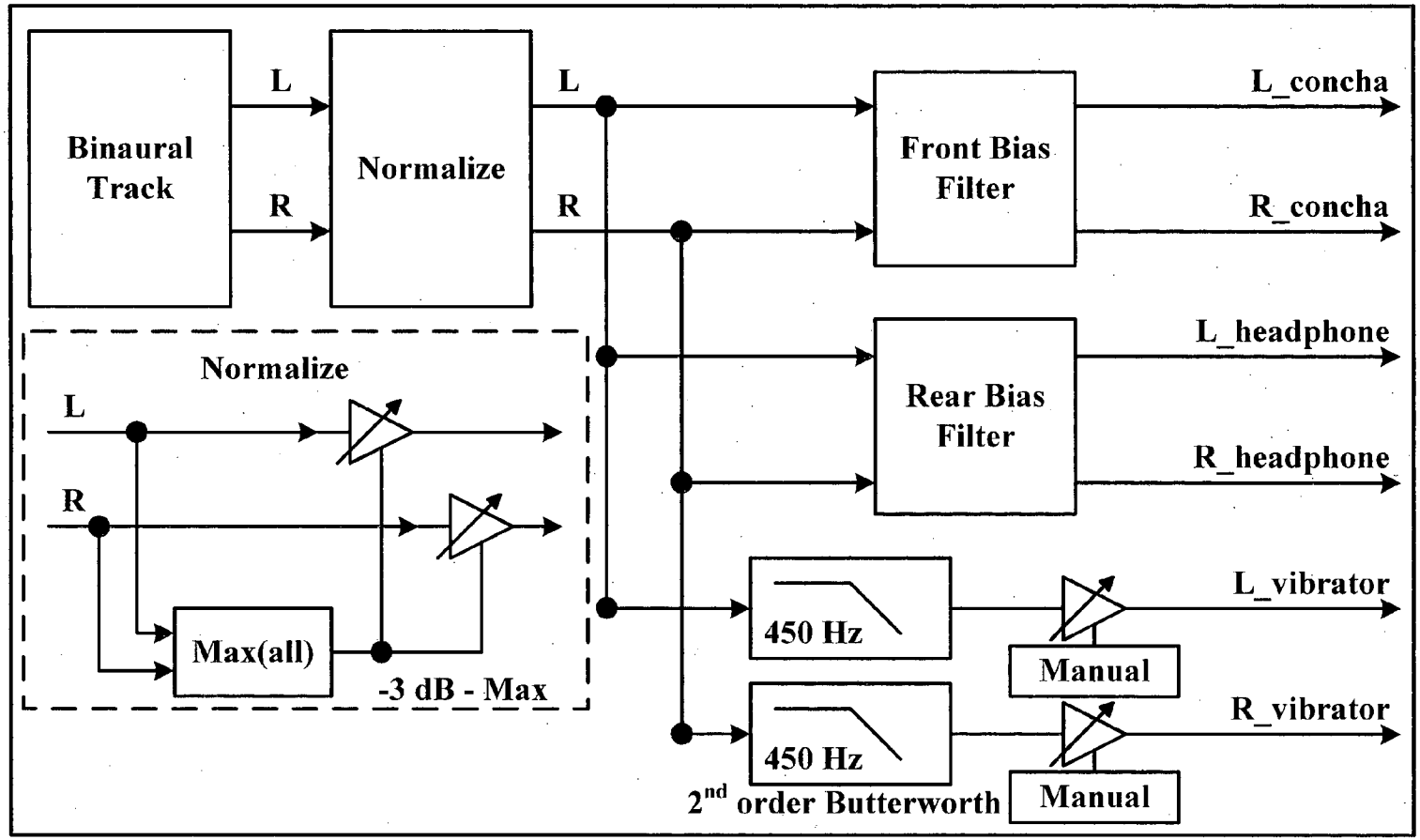
FIG. 11 shows a possible signal processing technique.

FIG. 11 shows a possible signal processing technique in the second stage to enhance the 2-channel signal before distributing to different emitters. The second stage of processing first performs normalization to the 2-channel signal derived from the first stage.

Figure 12:
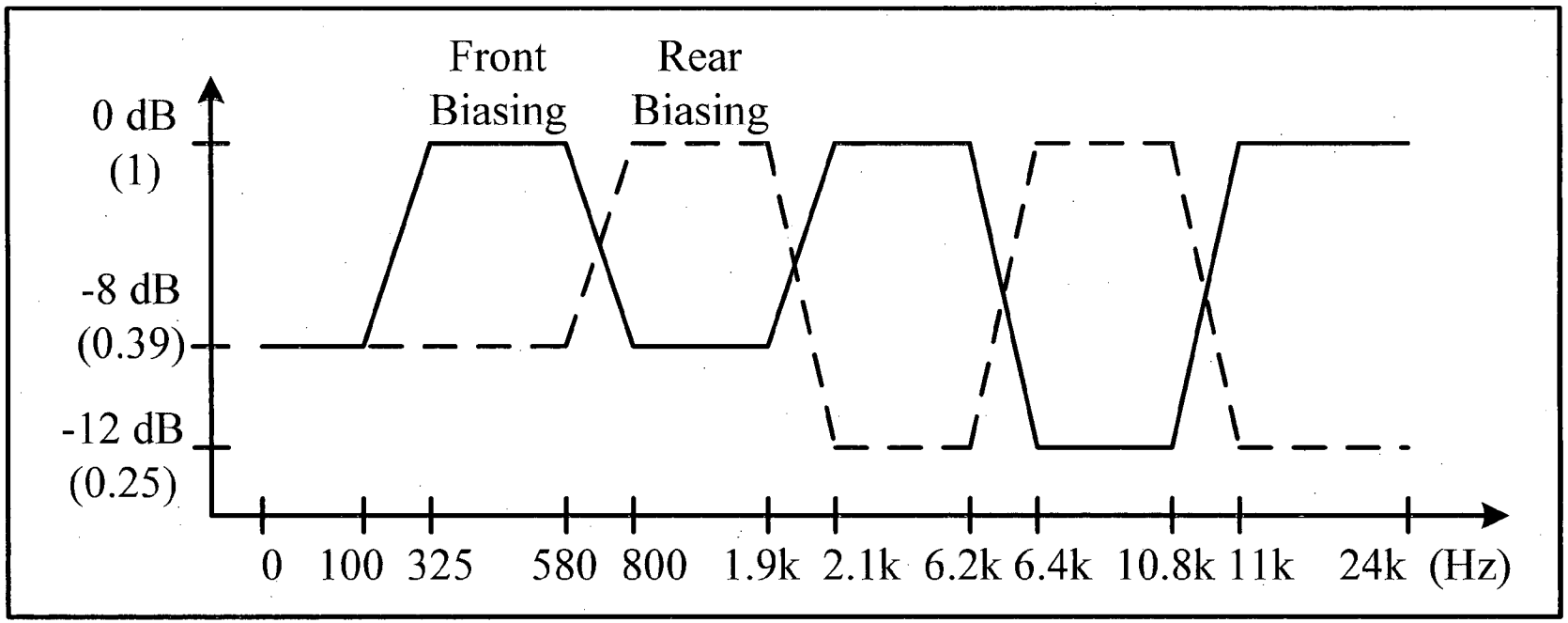
FIG. 12 schematically illustrates frequency responses of front and rear biasing filters.

Next, different processing techniques are applied to the pair of normalized signals to enhance the perceived auditory image send to the different pairs of emitters. In particular, frontal-biasing filters are applied to the 2-channel signal to enhance frontal auditory image in the concha emitters, and rear-biasing filters are applied to the vibrating emitters to enhance low-frequency and intimacy effect. The front and rear biasing filters enhance the perceived frontal and rear positioning of the sound image. The filters are based on Jens Blauert's subjective experiments on directional bands that affect frontal and rear perception. One possibility is as follows. There may be a five frequency filterbank with a frequency response as stated in Table 1. The filter is designed using the Filter Design and Analysis Tool (FDATool) in Matlab. A least square design method is chosen due to its reduced ripples in the pass band compared to the equiripple design method. The frequency responses for the frontal-biased filter (in solid line) and the rear-biased filter (in dash line) are plotted in FIG. 12. It is interesting to note the complementary frequency characteristics of the frontal and rear-biased filters.

TABLE 1

| | |
|---|---|
| Response Type | Multiband |
| Design Method | Least Square |
| Filter Order | 128 (129 taps) |
| Sampling Frequency | 48 kHz |
| Edge Frequency Vector | [0, 100, 325, 580, 800, 1900, 2100, 6200, 6400, 10800, 11000, 24000] |
| Front Biasing Magnitude Vector | [0.39, 0.39, 1, 1, 0.39, 0.39, 1, 1, 0.25, 0.25, 1, 1] |
| Rear Biasing Magnitude Vector | [0.39, 0.39, 0.39, 0.39, 1, 1, 0.39, 0.39, 1, 1, 0.25, 0.25] |
| Weight Vector | [1, 1, 1, 1, 1, 1] |

The signals for the vibrating emitters can be extracted from the 2-channel signals or directly from the low-frequency effect (LFE) signal from 5.1 surround sound format. A low-pass filter based on the 2nd order Butterworth infinite impulse response (IIR) filter with a cut-off frequency at 450 Hz is used to extract low-frequency content from the source. This cut-off frequency has been found to provide a good intimate/close effect. The levels of both low pass filtered and LFE signals are controlled manually to achieve the desired effect.

It will be appreciated by persons skilled in the art that the present invention may also include further additional modifications made to the device which does not affect the overall functioning of the device.

REFERENCES

[1] H. Møller, D. Hammershai, C. B. Jensen, and M. F. Sørensen, "Transfer Characteristics of Headphones Measured on Human Ears," J. Audio Eng. Soc., vol. 43, pp. 203-217 (1995 April).

[2] C. J. Tan and W. S. Gan, "Direct Concha Excitation for the Introduction of Individualized Hearing Cues," J. Audio Eng. Soc., vol. 48, pp. 642-653 (2000 July/August).

[3] F. M. König, "A New Supra-Aural Dynamic Headphone System for In-Front Localization and Surround Reproduction of Sound", presented at the 102nd AES Convention, Munich, Germany (1997 March).

[4] S. W. Weffer, "Surround Sound Headphone System," U.S. Pat. No. 7,155,025, (2006, December).

[5] H. Yoshimura and Y. Nishimura, "4-Channel Headphones," U.S. Pat. No. 3,984,885, (1976, October).

[6] K. Ohta, "Four Channel Headhone," U.S. Pat. No. 3,796,840, (1974, March).

[7] A. Nagayoshi, "Headphone Apparatus for Providing Dynamic Sound with Vibrations and Method Thereof," U.S. Pat. No. 6,603,863, (2003 August)

The invention claimed is:

1. A listening device (120; 220; 320) for wearing by a user, comprising:

at least one support structure (112; 226; 330) for positioning on or adjacent both ears (2) of the user;

said at least one support structure including, for each ear, one or more corresponding first sound emitters (116; 216; 316) and one or more corresponding second sound emitters (118, 218; 330);

characterised in that when the listening device is worn by the user, the first and second sound emitters (116, 118; 216; 218; 316; 330) are positioned such that, for each ear:

the one or more corresponding first sound emitters (116; 216; 316) direct sound in a different direction from the one or more corresponding second sound emitters (118, 218; 330); and a center of the one or more corresponding first sound emitters (116; 216; 316) is positioned to the anterior of the ear canal to emit sound in a posterior direction which is at an angle of at least 60 degrees to the axis of an ear canal of a user to direct sound at a wall portion of the concha of the ear.

2. A listening device according to claim 1 wherein at least one first sound emitter (116; 216, 316) emits sound in a direction substantially perpendicular to the axis of the ear canal (10).

3. A listening device according to claim 1, wherein at least one second sound emitter (118; 218) is positioned behind the pinna (4) of said one or both ears when the listening device is worn by the user.

4. A listening device according to claim 3 wherein the second sound emitters (118; 218) behind the ear are vibration exciters for generating low frequencies.

5. A listening device according to claim 1, wherein at least one second sound emitter (330) is positioned such that sound is directed toward the ear canal (6) of said one or both ears when the listening device is worn by the user.

6. A listening device according to claim 5 wherein the at least one second sound emitter (330) emits sound in a direction substantially parallel to the axis of the ear canal (6).

7. A listening device according to claim 1, wherein the support structure (112; 226; 330) includes one or more earcups (226; 326) enclosing the sound emitters (116, 118; 216; 218; 316; 330) therein.

8. A listening device according to claim 1, wherein the listening device includes left and right sides corresponding to the user's ears, and the support structure (112; 226; 330) includes an over-the-head headband (226), behind the head loop, or spectacles/glasses structure connecting said left and right sides.

9. A method of generating sound, comprising the steps of:

extracting cues from sound sources;

processing the cues to generate a plurality of sound signals;

delivering one or more of the sound signals to one or more first sound emitters (116; 216, 316), and a different one or more of the sound signals to one or more second sound emitters (118; 218; 330);

characterised in that a center of the one or more first sound emitters is positioned to the anterior of the ear canal to emit sound in a posterior direction which is at an angle of at least 60 degrees to the axis of an ear canal of a user to direct the sound at a wall portion of the concha of the ear, wherein one or more of the second sound emitters emit sound in a different direction from the one or more first sound emitters.

10. A method according to claim 9 in which the first sound emitters emit sound in a direction which is at an angle of at least 70 degrees to the axis of the ear canal of the user.

11. A method according to claim 9, wherein at least some of the sound signals are delivered to a second sound emitter positioned behind the pinna of said one or both ears.

12. A method according to claim 9, wherein at least some of the sound signals are delivered to a second sound emitter positioned facing the ear canal of one of the user's ears.

13. A method according to claim 9, wherein the cues are processed via convolution with a set of head related impulse responses.

14. A method according to claim 9, wherein the cues are processed with a filterbank structure and/or adjustable gain.

15. A method according to claim 9, wherein the cues are processed to separate the frontal and side signals from the audio input, by computing the correlation and time differences between the left and right signals.

16. A method according claim 15 wherein highly correlated signals with small time differences are delivered to the first sound emitters (116; 216, 316).

17. A method according to claim 9 comprising extracting low-frequency signals from the sound sources using a low-pass filter and delivering the low-frequency signals to the one or more second sound emitters to produce low-frequency content of the sound sources.

* * * * *